United States Patent [19]

Levitov et al.

[11] 4,101,727

[45] Jul. 18, 1978

[54] HIGH-TENSION ELECTRIC CABLE

[76] Inventors: Vladimir Ilich Levitov, ulitsa Vavileva 48, kv. 7; Andrei Grigorievich Lyapin, Vystavochny pereulek 5, kv. 39; Oleg Vasilievich Scherbina, ulitsa Amundsena 16, kv. 76, all of Moscow, U.S.S.R.

[21] Appl. No.: 714,748

[22] Filed: Aug. 16, 1976

Related U.S. Application Data

[63] Continuation of Ser. No. 531,814, Dec. 11, 1974, abandoned, which is a continuation-in-part of Ser. No. 278,653, Aug. 7, 1972, abandoned.

[51] Int. Cl.[2] ..... H01B 9/04

[52] U.S. Cl. ..... 174/28; 174/16 B

[58] Field of Search ..... 174/28, 29, 16 B, 111, 174/142, 99 B

[56] References Cited

U.S. PATENT DOCUMENTS

| | | | |
|---|---|---|---|
| 3,324,272 | 6/1967 | Shankle et al. | 174/28 X |
| 3,356,785 | 12/1967 | Yoshida et al. | 174/28 |
| 3,801,725 | 4/1974 | Farish | 174/28 |

FOREIGN PATENT DOCUMENTS

| | | | |
|---|---|---|---|
| 768,334 | 5/1934 | France | 174/28 |
| 955,792 | 12/1956 | Fed. Rep. of Germany | 174/28 |
| 274,597 | 6/1930 | Italy | 174/28 |
| 4,417,464 | 8/1969 | Japan | 174/28 |

*Primary Examiner*—Arthur T. Grimley

[57] ABSTRACT

High-tension electric cable comprising a metal sheathing; an inner coaial current-conducting core; a main insulation of compressed gas filling the space between the core and the sheathing; spaced toroidal supporting insulators for centering the core and having therein semicircular grooves in the areas of contact with the core and with the sheathing; the grooves having shielding electrodes therein which have contact with the core and with the sheathing; the generatrix of the side surfaces of the insulators coinciding with the electrostatic line of force of the cable, at any point of which the gradient of electrostatic potential is lower than the gradient on the surface of the core in the space or spaces between said insulator elements; the line of force, coinciding with the generatrix of the side surfaces, being so disposed in a longitudinal section of the cable that it begins on the surface of the core at a distance $x = 1.1\,r$ from the center of the semicircular section of the grooves which have the shielding electrodes, $r$ being the radius of section of the grooves.

1 Claim, 4 Drawing Figures

HIGH-TENSION ELECTRIC CABLE

This is a continuation of application Ser. No. 531,814 filed Dec. 11, 1974, now abandoned, which is a Continuation-in-Part of application Ser. No. 278,653, filed Aug. 7, 1972 now abandoned.

The present invention relates to the field of power transmission and distribution and more precisely to high-tension electric cables. It can be used in complete indoor distribution installations at power stations and sub-stations, in extending high-tension lines deep into populated areas, and in enclosed ultra-high-voltage power transmission lines.

Until recently, the most economic high-tension transmission lines were those of the open type, with the majority of structures, such as the line wires and the external insulation of the apparatuses, being in the open air.

However, as the throughput and hence the associated voltages increased, an ever increasing ineffectiveness of air as an insulating medium for ultra-high voltages was revealed. On the one hand, this manifests itself in an absolute potential effect, i.e. in a sharply retarded increase of the breakdown voltage per unit of height, as the distance between the wire and the earth is increased; and on the other hand, the conventional ways of preventing considerable power losses, as well as high-frequency interference due to the corona effect on the wires, appear to be exhausted. There are grounds for believing that open power transmission, as commonly known, has reached the limits of its possibilities.

In this connection, underground high-tension power transmission means, in particular oil-filled cables rated at voltages in the order of 400 kV and higher, are being intensively developed. A more effective solution of the problem, however, is the creation of high-tension cables with their main insulation being in the form of a compressed gas.

Cables of this type possess a number of advantages over overhead power transmission lines and oil-filled cables or cables with paper-oil insulation, namely: higher throughput due to the application of rigid conductors of a larger cross-section and because of high heat conduction properties of compressed gas; low dielectric losses and practically complete absence of corona losses; protection against atmospheric effects (icing, lightning strokes, fouling of insulators, etc.); absence of radio interference; increased critical cable length due to reduced specific capacity (at any working pressure the dielectric constant of gas is equal to unity); the possibility of making insulation to suit any desired voltage levels (up to millions of volts); simplicity of design and ease of mounting.

In the devices of this type, the current-conducting core and the sheathing are retained in a coaxial relationship by means of supporting insulator elements made of a solid dielectric, while the space between them is filled with a compressed gas.

In the mounted devices of this type, in the region where the supporting insulator elements come into contact with the sheathing, gas inclusions occur, wherein the electric potential gradient substantially increases owing to the difference in the dielectric permittivity of the solid and the gaseous insulating media. This results in an early ionization of the gas inclusions, leading to surface flashover of the supporting insulator elements, which occurs at voltages that are considerably lower than the breakdown voltage of the surrounding gas.

The effect tends to increase with an increase in gas pressure until, at a pressure of a few barometric atmospheres, the value of the surface flashover voltage of the supporting insulator elements drops to one-half or even less of the breakdown voltage of the gas.

This purpose is achieved in an electric high-tension cable which has its main insulation in the form of a compressed gas, wherein spaced toroidal supporting insulation elements, that serve for centering a current-conductive core relative to a coaxially disposed metal sheathing, are provided with semicircular grooves with built-in shielding electrodes having electrical contact with the core and the sheathing. According to the invention, the generatrix of the side surfaces of the insulator elements is so selected as to coincide with the electrostatic line of force of the cable, at any point of which the gradient of electrostatic potential is lower than the gradient on the surface of the core in the space or spaces between the supporting insulator elements.

It is further preferred in such high-tension electric cables according to the invention to provide the grooves in the insulator elements with a radius $r$ equal to 0.2 to 0.25 of the distance between the core and the sheathing, and to make the side surfaces of the insulator elements with a generatrix, whose equation in a rectangular coordinate system (X, Y), originating in the center of the circumference of a section taken across the grooves, takes the form:

$$Y = r\,[\,(1.82 - 0.72\,e^{-1.3(x/r)}) - (Ae^{+1.2(x/r)})\,],$$

wherein A is a coefficient equal to 0.005 in case of a high-tension electric cable having the shielding electrodes arranged both from the side of the core and the metal sheathing, and equal to zero for a similar cable having the electrodes disposed only from the side of the core.

In the above equation, the distance $x$ is 1.1 times the radius of section of the semicircular grooves in the toroidal supporting insulator elements, from the center of the semicircular section of the grooves which have the shielding electrodes therein.

In a more specific aspect of the invention, it is directed to a high-tension electric cable comprising: a metal sheathing; an inner current-conducting wire in the form of a core, secured coaxially inside the sheathing; a main insulation of compressed gas filling the space between the core and the sheathing; spaced-apart toroidal supporting insulator elements for centering the core relative to the sheathing and having therein semicircular grooves in the areas of contact with the core and with the sheathing; the grooves having shielding electrodes built therein which have electrical contact with the core and with the sheathing; the generatrix of the side surfaces of the insulator elements coinciding with the electrostatic line of force of the cable, at any point of which the gradient of electrostatic potential is lower than the gradient of the surface of the core in the space or spaces between said insulator elements; the line of force, coinciding with the generatrix of the side surfaces of the insulator elements, being so disposed in a longitudinal section of the cable that it begins on the surface of the core at a distance $x = 1.1\,r$ from the center of the semicircular section of the grooves which have the shielding electrodes, $r$ being the radius of section of the grooves.

Several exemplary embodiments will be described hereinafter, all being characterized by the just recited features.

A fuller understanding of the nature and objects of the invention will be had from the following detailed description of the exemplary embodiments a high-tension electric cable according to the invention, taken in conjunction with the accompanying drawings, in which.

Figure 1:
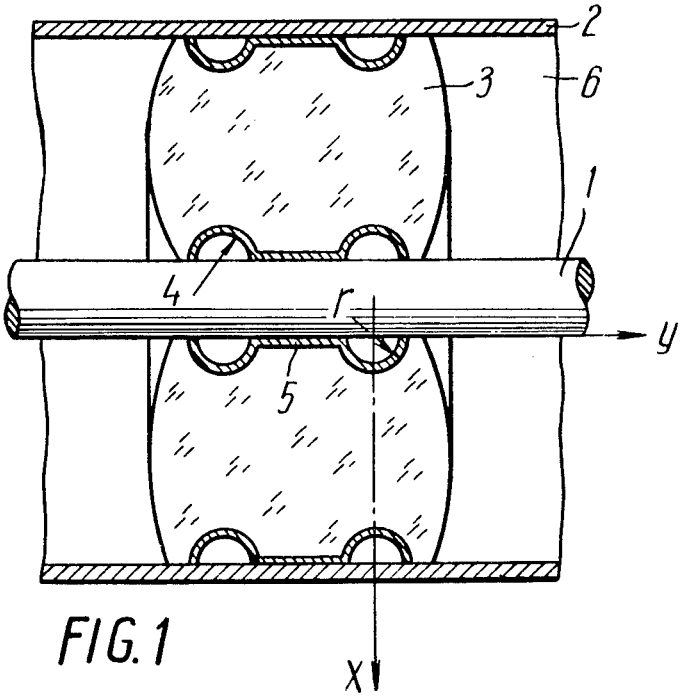
FIG. 1 shows the longitudinal section of an exemplary high-tension electric cable according to the invention.

The high-tension electric cable according to the invention, in a first exemplary embodiment, comprises a current conducting core 1 (FIG. 1) and a metal sheathing 2 coaxially disposed relative to the core.

The core 1 is secured inside the metal sheathing 2 with the help of toroidal supporting insulator elements 3, made of an insulating material, for example porcelain, epoxy compound, ceramics, etc.

On the contact surfaces of the supporting insulator elements 3, adjacent to the surfaces of the core 1 and of the sheathing 2, there are provided circular grooves 4 having a semicircular section, with shielding electrodes 5 built therein, the electrodes being in electric contact with the core 1 and the metal sheathing 2, respectively.

The electrodes 5 can be made either by filling the grooves 4 with metal or by covering the groove surfaces with a conducting layer, for example metal spraying, or by placing hollow metal rings into the grooves 4, which are pressed out to profile.

The space between the core 1 and the sheathing 2 is filled up with a compressed gas 6, for example nitrogen or sulphur pentafluoride ($SF_6$).

Figure 2:
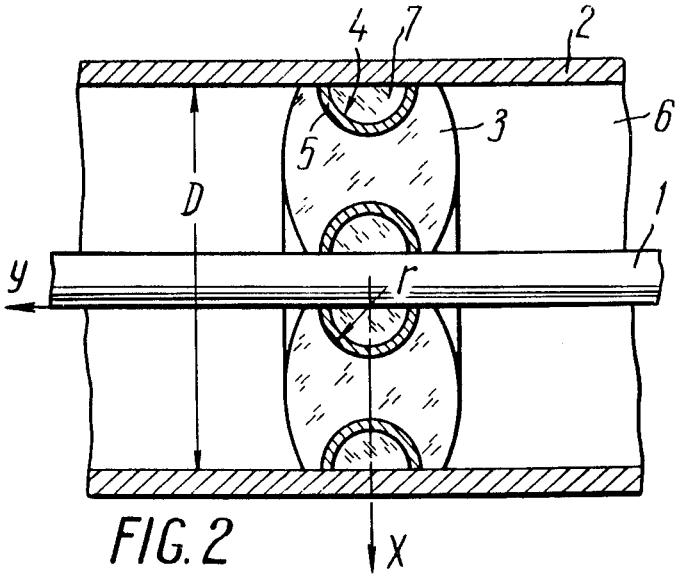
FIG. 2 is a modified embodiment of the inventive cable, having a toroidal supporting insulator element with one circular groove on the side of a current-conducting core and one circular groove on the metal sheathing side.

In the first exemplary embodiment described above, the insulator element 3 in the electric cable features two shielding electrodes 5 on each of the two contact surfaces, i.e. on the core side and the metal sheathing side; however, each of the contacting surfaces can be provided with only one shielding electrode 5 (refer to the modification of FIG. 2).

In this case the built-in electrodes are in the form of hollow metal rings pressed out to fit the groove cross-section, while the free space is filled with any insulating compound 7. The shielding electrodes built into the supporting insulator elements exert an influence on the electric field inside the cable, due to which the potential gradient along the lines of force adjacent the electrodes becomes so distributed that, at any point along the line of force, it is lower than that on the surface of the current-conducting core of the cable, in the space between the supporting insulator elements.

Simultaneously the electrostatic field intensity in the sections of the lines of force adjacent to the core 1 and the sheathing 2 drops sharply as compared with similar sections of the same lines of force located in the spaces between the insulator elements, while in the middle part of the line of force the field intensity somewhat increases.

As a result of the above, the electrostatic field along the lines of force becomes more even. A similar distribution of the potential gradient takes place on the surface of the supporting insulator element 3, whose generatrix coincides with one of the lines of force. It was on the basis of the above that the lateral surface of the supporting insulator element has been determined.

Radius $r$ (FIG. 1) of circular grooves 4 is preferably taken within 0.2 to 0.25 of the distance between the current-conducting core 1 and the metal sheathing 2.

In this case the lateral surface of the supporting insulator element 3 will have a generatrix, whose equation in a rectangular system of coordinates (X, Y), originating in the center of circumference of a section taken across the circular groove, will take the form:

$$Y = r\,[\,(1.82 - 0.72\,e^{-1.3(x/r)}) - (Ae^{+1.2(x/r)})\,],$$

wherein A = 0.005.

In this case the formula assumes the form:

$$Y = r\,[\,(1.82 - 0.72\,e^{-1.3(x/r)}) - (0.005^{+1.2(x/r)})\,].$$

Figure 3:
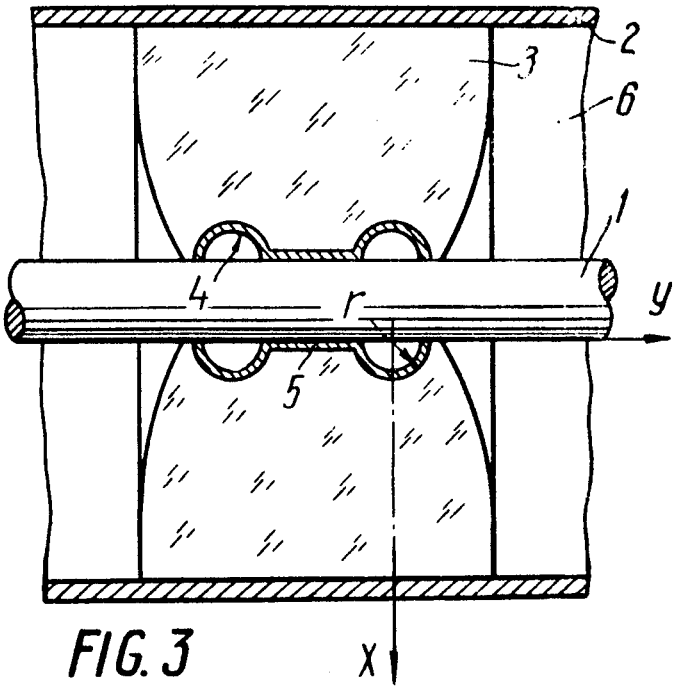
FIG. 3 is another embodiment of a high-tension electric cable according to the invention, having a toroidal supporting insulator element with two circular grooves provided only on the core side.
Figure 4:
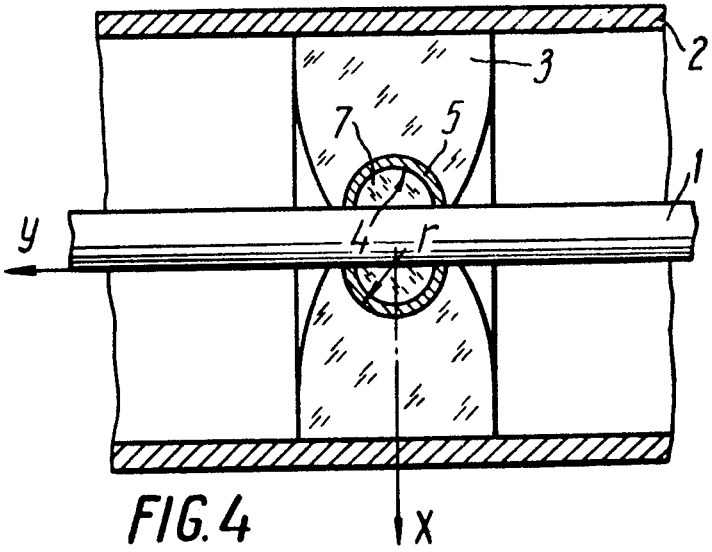
FIG. 4 is yet another embodiment of a high-tension electric cable according to the invention, having a toroidal supporting insulator element with only one circular groove on the core side.

In an embodiment of the electric cable wherein the ratio of the internal diameter of the metal sheathing to the core diameter is greater than 3, the shielding electrodes are allowed to be arranged only from the conducting core side (FIGS. 3 and 4). The lateral surface of the supporting insulator element 3 (FIGS. 3 and 4) has a generatrix, whose equation in a rectangular system of coordiantes (X, Y), originating in the center of circumference of a section taken across the circular groove, will take the form:

$$Y = r\,(1.82 - 0.72\,e^{-1.3(x/r)}).$$

From the formula it is seen that the coefficient A = 0. In the cables as disclosed above there has been achieved in practice a coincidence of the surface flashover voltage of the toroidal supporting insulator elements with the breakdown voltage of the compressed gas in the pressure range up to 21 atm.

It will be understood from the forgoing description that the basic idea of the present invention is to coordinate the shape and the size of the built-in electrodes with the lateral or side surfaces of the insulators. This is necessary because the use of built-in electrodes in itself does not increase the voltage of the insulator surface covers to the breakdown voltage of the surrounding compressed gas.

The accompanying drawings show that the shape of the insulator elements is characterized by a narrowing at the inner conductor of the cable. Moreover, which is most important, the generatrix of the side surfaces of the insulator elements coincides with a pre-selected line of force of the electric field, along which the strength of the field is so distributed that the conditions are less favorable for a discharge to spead along the insulator surfaces than in the surrounding gas.

It has been proved experimentally that the above explained features ensure an unprecedented electric strength of the cable and prevent discharge concentrations along the insulator surfaces.

The following figures illustrate the value of the electrical strength ensured by the invention. Under $SF_6$ pressure of 3 atmosphere, the breakdown gradient of the cable core is 200 to 250 kV/cm for the negative, least favorable polarity of the dc voltage, and when the pressure rises to 5 atmospheres, the breakdown gradient increases to more than 350 kV/cm.

What we claim is:

1. An improved high-tension cable employing an outer metal sheathing; a substantially coaxial inner current-conducting wire in the form of a core, running longitudinally inside said sheating, and having radially directed outer surfaces that are substantially parallel with the longitudinal direction of the cable; a main insulation of compressed gas filling the space between said core and said sheathing; spaced-apart, partly toroidal insulator elements for supporting and coaxially securing said core relative to said sheathing, said insulator elements narrowing in at least their portions that face and contact said core, and having therein at least one pair of semicircular grooves in at least said contact portions of the insulator elements, said improvement comprising: said grooves being open towards said core; and at least one pair of shielding screen electrodes in electrical contact with at least said core, built into said grooves in the insulator elements, adjoining said contact portions of the latter; said screen electrodes having dimensions conforming to one-quarter of the distance between said screen electrodes; said insulator elements having side surfaces facing in the longitudinal direction, with a partly rectilinear and partly toroidal generatrix, the latter coinciding with the electrostatic line of force of the electric cable, at any point of which the gradient of electrostatic potential is lower than the gradient on said outer core surfaces in at least one of the spaces between successive ones of said insulator elements; said side surfaces being aligned with said current-conducting core; the line of force, coinciding with the generatrix of said insulator side surfaces, being so disposed in any longitudinal section of the electric cable that the line of force begins on said outer core surfaces at a distance $x = 1.1\ r$ from the center of the semicircular section of said grooves which have therein said shielding electrodes, $r$ being the radius of the section of said grooves.

* * * * *